US006540420B2

(12) United States Patent
Fujioka et al.

(10) Patent No.: US 6,540,420 B2
(45) Date of Patent: Apr. 1, 2003

(54) RECORDING APPARATUS

(75) Inventors: Satoshi Fujioka, Nagano (JP); Hiroshi Asawa, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 79 days.

(21) Appl. No.: 09/737,824

(22) Filed: Dec. 18, 2000

(65) Prior Publication Data

US 2001/0021333 A1 Sep. 13, 2001

(30) Foreign Application Priority Data

Dec. 17, 1999 (JP) ..... 11-358354
Nov. 30, 2000 (JP) ..... 2000-364740

(51) Int. Cl.[7] ..... B41J 11/58; B41J 13/02; B41J 15/20; B41J 11/26

(52) U.S. Cl. ..... 400/624; 400/605; 400/611; 400/625; 400/636

(58) Field of Search ..... 400/624, 605, 400/611, 625, 636

(56) References Cited

U.S. PATENT DOCUMENTS 4,502,804 A 3/1985 Willcox
5,131,771 A * 7/1992 Kawahara ..... 400/605
5,169,250 A * 12/1992 Tsuru et al. ..... 400/611
5,927,702 A * 7/1999 Ishii et al. ..... 271/9.09
6,196,672 B1 * 3/2001 Ito et al. ..... 347/88
6,336,759 B1 * 1/2002 Nakano ..... 400/625

FOREIGN PATENT DOCUMENTS

EP 0527040 A2 2/1993
EP 0542270 A2 5/1993
EP 0915050 A1 5/1999

* cited by examiner

*Primary Examiner*—Andrew H. Hirshfeld
*Assistant Examiner*—Marvin P Crenshaw
(74) *Attorney, Agent, or Firm*—Sughrue Mion, PLLC

(57) ABSTRACT

A transport roller 32 has high rigidity and the surface supported at its center portion thereof is formed as a low-friction surface 32*a* by the polish finishing process and the surface thereof except for the low-friction surface is formed as a high-friction surface 32*b* by the ceramic coating process. The driven roller 33 is disposed so as to oppose to the low-friction surface in a manner that the surface thereof extends over the boundary of the low-friction surface 32*a* and the high-friction surface 32*b*. The driven roller 33 may be disposed in a manner that the surface thereof extends over the entire width of the low-friction surface 32*a*.

11 Claims, 6 Drawing Sheets

RECORDING APPARATUS

BACKGROUND OF THE INVENTION

The present invention relates to a recording apparatus capable of recording on recording paper with a paper width of almost size A1 or B1 at the maximum and, more particularly, relates to a recording apparatus including a transport roller structure which is suitable for ensuring the stable transport of the paper at a center supporting portion which supports a long transport roller for transporting the recording paper at the center portion thereof to thereby suppress the occurrence of cockling phenomenon.

Most of large-sized recording apparatuses employ such a structure that a paper feeding section is disposed at the upper portion in the rear of the main body of the recording apparatus, recording paper is fed toward the front portion of the recording apparatus from the paper feeding section and transported to a recording section by way of a slanted paper transport path, then the paper subjected to the recording process is ejected in the slanted downward direction from a paper ejecting section, and the paper thus ejected is received by a receiving unit provided at the lower portion of the recording apparatus.

In such a recording method, the recording paper in the form of a paper in which paper is wound on a core, or a cut sheet is fed to the recording section and the recording is conducted by a recording head which is mounted on a carriage and moves reciprocally.

A paper feeding section is constituted by a transport roller driven and rotated by a motor and a driven roller which rotates in accordance with the rotation of the transport roller. The paper feeding section is disposed near the recording head and arranged in a manner that the driven roller acts to press the recording paper against the transport roller thereby to transport the recording paper toward the recording area where the recording head exists.

A large-sized recording apparatus accorded to the wide recording paper requires a long transport roller corresponding to the width of the recording paper, so that a paper feeding section thereof employs the structure that many driven rollers are disposed in parallel to the long transport roller. In this respect, in order to feed the recording paper with a high accuracy, a spring member is provided at every driven roller so that a predetermined urging force is uniformly applied to the entire width of the recording paper to thereby push the recording paper against the transport roller.

Such a long transport roller bends at the center portion thereof due to various reasons. At the time of the fabrication, the transport rollers bend slightly due to mechanical allowance or tolerance. Further, when the transport roller is laid so as to be supported at the both ends thereof, the transport roller bends at its center portion due to its own weight. Furthermore, the degree of the flexure of the transport roller differs depending on that the roller is formed as a tubular member or a pillar member. For example, when the roller is formed by a thin-walled tubular member, the roller has such a nature that the thicker the wall thickness becomes, the less the roller bends.

Such a bending phenomenon of the transport roller degrades the transporting accuracy of the recording paper and results in the degradation of the recording quality thereof. As a countermeasure for such a phenomenon, when the diameter of the transport roller is made large to such a degree for preventing the bending of the roller caused by its own weight, there arises such a problem that a larger space for disposing such a transport roller is required and the size of a bearing portion also becomes large. Accordingly, such a transport roller with a large diameter is not practical.

Further, since the transport roller is applied with pressure (load) from the driven rollers, the transport roller also bends due to this pressure. When comparing the bending amount of the transport roller due to the mechanical allowance, tolerance upon fabricating the rollers, or its own weight with the bending amount due to the load of the driven rollers, the latter amount is larger than the former amount. In particular, a bending amount becomes larger due to the multiplier effect of these bending phenomena, and this bending amount becomes larger as the length of the transport roller becomes longer and the diameter of the transport roller becomes smaller, so that the transporting accuracy of the recording paper is further influenced.

As a countermeasure for such influence, it is considered to provide such a structure that the transport roller is supported at the center portion thereof to thereby suppress the bending phenomenon of the transport roller. According to this center supporting structure for supporting the transport roller, since a slight concave is formed at the portion where the transport roller is supported, there arises such a problem that, due to the presence of the concave portion, the transporting operation of the paper becomes unstable and the concave portion likely becomes an origin for generating the cockling phenomenon that the recording paper is moisten by ink and so expands and waves.

SUMMARY OF THE INVENTION

Accordingly, an object of the invention is to provide a recording apparatus which can suppress the unstable transporting operation of papers at the center supporting portion of a transport roller and also suppress the generation of origin of cockling phenomenon.

In order to achieve the above object, according to the present invention, there is provided a recording apparatus comprising:

- a first roller arranged parallel with a main direction of a recording head for transporting a recording paper, the paper transporting roller including a first portion provided with a surface having a first friction coefficient and a first diameter, and a second portion provided with a surface having a second friction coefficient larger than the first friction coefficient and a second diameter larger than the first diameter;
- a second roller driven by the first roller while providing pressure to be applied onto the recording paper toward the first roller, the second roller opposed to the first roller such that a roller surface thereof extends over a boundary of the first portion and the second portion of the first roller; and
- a supporting member for supporting the first portion of the first roller rotatably thereon.

In this configuration, since the paper is transported while being gripped by the second roller (driven roller) and the second portion (high-friction surface) of the first roller (paper transport roller), high paper transporting accuracy can be attained and so the degradation of recording quality can be prevented. Further, when the driven roller provides pressure against the transport roller, the surface of the driven roller is slightly so deformed elastically as to be bent toward the first portion (low-friction surface) to thereby press the recording paper against the low-friction surface of the transport roller.

Thus, a force for gripping the paper surely acts on the paper and so the paper can be transported stably even though the transport roller is provided with the low-friction surface which diameter is slightly smaller than that of the high-friction surface. Further, the recording paper running between the driven roller and the low-friction surface of the transport roller is restricted in its position by the surface of the driven roller in a state that the surface of the driven roller extends over the low-friction surface and the high-friction surface at the boundary portions between the low-friction surface and the high-friction surface and the elastically-deformed driven roller almost eliminates the gap with respect to the low-friction surface, so that the generation of origin of the cockling phenomenon at the low-friction surface portion can be suppressed.

Preferably, the supporting member is arranged so as to oppose to the second roller through the first roller.

In this configuration, when the load of the driven roller is applied to the transport roller, the load is received by the supporting member through the transport roller, it is possible to suppress the bending of the transport roller.

Preferably, the roller surface of the second roller extends so as to oppose to an entire width of the first portion of the first roller.

In this configuration, since the surface of the driven roller is disposed in opposite to the entire width of the low-friction surface of the transport roller, the transporting stability of the recording paper which is transported while opposing to the low-friction surface can be further improved. Further, the generation of origin of the cockling phenomenon can be suppressed not only at the low-friction surface portion but over the entire width of the low-friction surface.

Alternatively, the roller surface of the second roller extends so as to oppose to a part of the first portion of the first roller.

In this configuration, since a driven roller to be positioned in opposition near the center portion of the low-friction surface, at which origin of the cockling phenomenon is hardly generated, can be eliminated, a more economical supporting member can be provided.

Preferably, the roller surface of the second roller opposes to both widthwise end portion of the first portion of the first roller.

In this configuration, since a uniform pressure is applied to near the both sides of the low-friction surface of the transport roller, there does not occur a difference in the paper feeding speed at the both end sides of the low-friction surface.

Preferably, the second roller includes a plurality of individual rollers respective widths of which are identical with each other.

In the configuration, the manufacturing cost of the apparatus can be reduced and the management cost also can be reduced due to the decrease of the number of kind of components.

Preferably, the second roller includes a plurality of individual driven rollers. A widthwise dimension of the individual driven roller opposing to the entire width of the first portion of the first roller is larger than another individual driven rollers.

In this configuration, since the action affected on the transport roller by the driven roller opposing to the low-friction surface becomes similar to the action affected on the transport roller by the other driven rollers, the transporting stability of the paper can be further improved.

Preferably, the surface of the second portion of the first roller is defined by a coating layer.

In this configuration, the friction coefficient of the roller capable of obtaining high transporting accuracy can be fabricated easily.

Preferably, a thickness of the coating layer is within a range of 15 $\mu$m to 100 $\mu$m.

In this configuration, the roller having efficiency suited to the specification of the recording apparatus can be obtained by selecting the thickness of the coating layer.

Preferably, the difference between the first diameter and the second diameter is twice of the thickness of the coating layer.

In this configuration, a difference corresponding to the thickness of the coating film is formed between the low-friction surface and the driven roller. Since the thickness of the coating film is very small, the transporting stability of the paper is prevented from being degraded and the generation of origin of the cockling phenomenon can be suppressed.

Preferably, the second portion of the first roller is arranged in both sides portion of the first portion thereof, and urged by the second roller.

In this configuration, since the paper is restricted in its movement due to the small gap corresponding to the thickness of the coating film between the low-friction surface and the driven roller, the transporting stability of the paper is prevented from being degraded and the generation of origin of the cockling phenomenon can be suppressed surely.

DETAILED DESCRIPTION OF THE PREFERRED EMBODIMENTS

Figure 1:
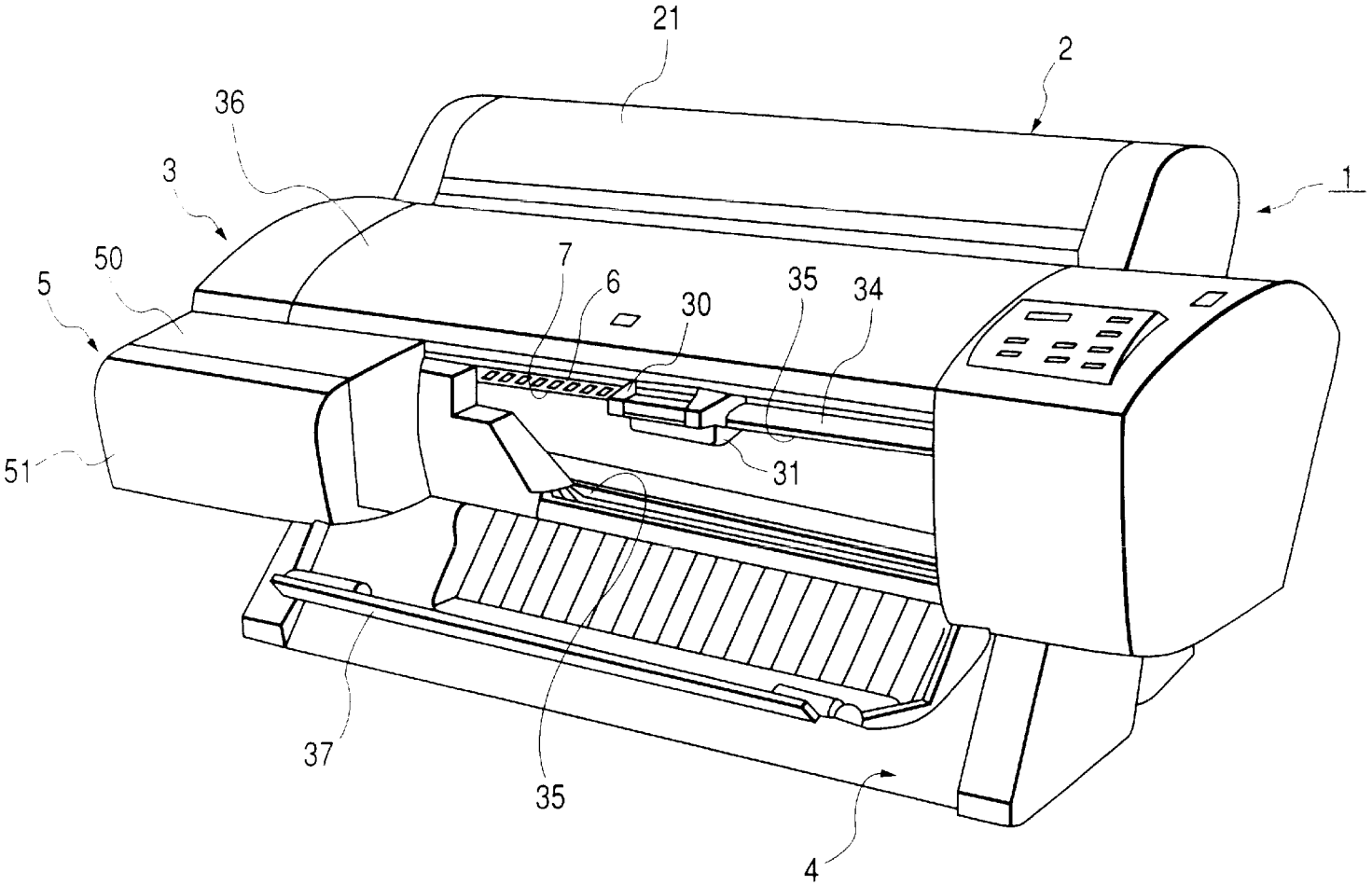
FIG. 1 is a perspective view showing a state where a front cover of a main body of a recording apparatus is opened.

The preferred embodiments of the invention will be explained with reference to the accompanying drawings. The embodiment relates to a large sized recording apparatus capable of recording on recording paper with a paper width of almost size A1 or B1 at the maximum, to which the invention is applied.

The recording apparatus 1 is formed by a paper feeding section 2, a recording section 3 and a paper ejecting section 4. The paper feeding section 2 is provided at the rear upper portion of the recording apparatus 1 so as to protrude upward. A roll-shaped recording paper 20 is set within the paper feeding section and a paper cover 21 is attached to the paper feeding section to cover the recording paper 20 so as to be able to open and close freely.

The recording section 3 includes a carriage 30 having a recording head 31 mounted thereon, a transport roller 32 and driven rollers 33 which transports the recording paper 20 in the sub-scanning direction, an ink supplying unit for supplying ink to the recording head 31, a paper suction unit which sucks the open air from a suction opening 41 provided at a paper transport path 40 to suck the recording paper 20 to thereby prevent the recording paper from floating, and a control unit for executing the recording procedure etc. Further, the recording section is provided with a top cover 36 and a front cover 37 so as to cover the carriage 30, a flat cable 34, ink tubes 35, the paper transport path and so on. The front cover 37 is rotatably supported at its lower portion positioned on the paper transport surface side. The carriage 30 is suspended through a roller from a rail 7 which is supported at its both ends by a side frame 39, and also coupled to a carriage belt 6. When the belt 6 is operated by a carriage driver (not shown), the carriage 30 links with the movement of the carriage belt 6 and is guided by the rail 7 to thereby move reciprocally therealong. The recording head 31 is coupled to the flat cable 34 for sending a recording signal from the control unit to the recording head and also coupled to the ink tubes 35 for supplying ink to the recording head.

The recording section 3 is provided at its front side with a cartridge holder 5 constituting the ink supplying device. A holder body 50 of the cartridge holder 5 accommodates ink cartridges 52 of six colors (yellow, light magenta, light cyan, magenta, cyan and black) in a manner that these ink cartridges are disposed side by side and so as to be able to be detachably inserted from the front side. The holder body 50 is provided with a holder cover 51 which is arranged to cover the inserted ink cartridges 52 and so as to be able to be closed and opened. The ink of the respective colors are supplied to the recording head 31 through the ink tube 35 and used for the recording on the recording paper 20.

The recording operation of the recording apparatus 1 of this embodiment is performed in the following manner. That is, the recording paper 20 fed from the paper feeding section 2 is intermittently sent to a platen 48 side by the cooperative operation of the transport roller 32 and the driven roller 33, then the recording operation on the recording paper is performed by the reciprocal operation of the recording head 31, and the recording paper 20 thus recorded is ejected in the slanted downward direction from the recording apparatus 1 by an ejection roller 42 in the paper ejecting section 4. A cutter (not shown) for cutting the recording paper 20 is provided between the recording section 3 and the paper ejecting section 4 so that, after the completion of the recording operation, the recording paper is cut by the cutter and ejected.

Figure 2:
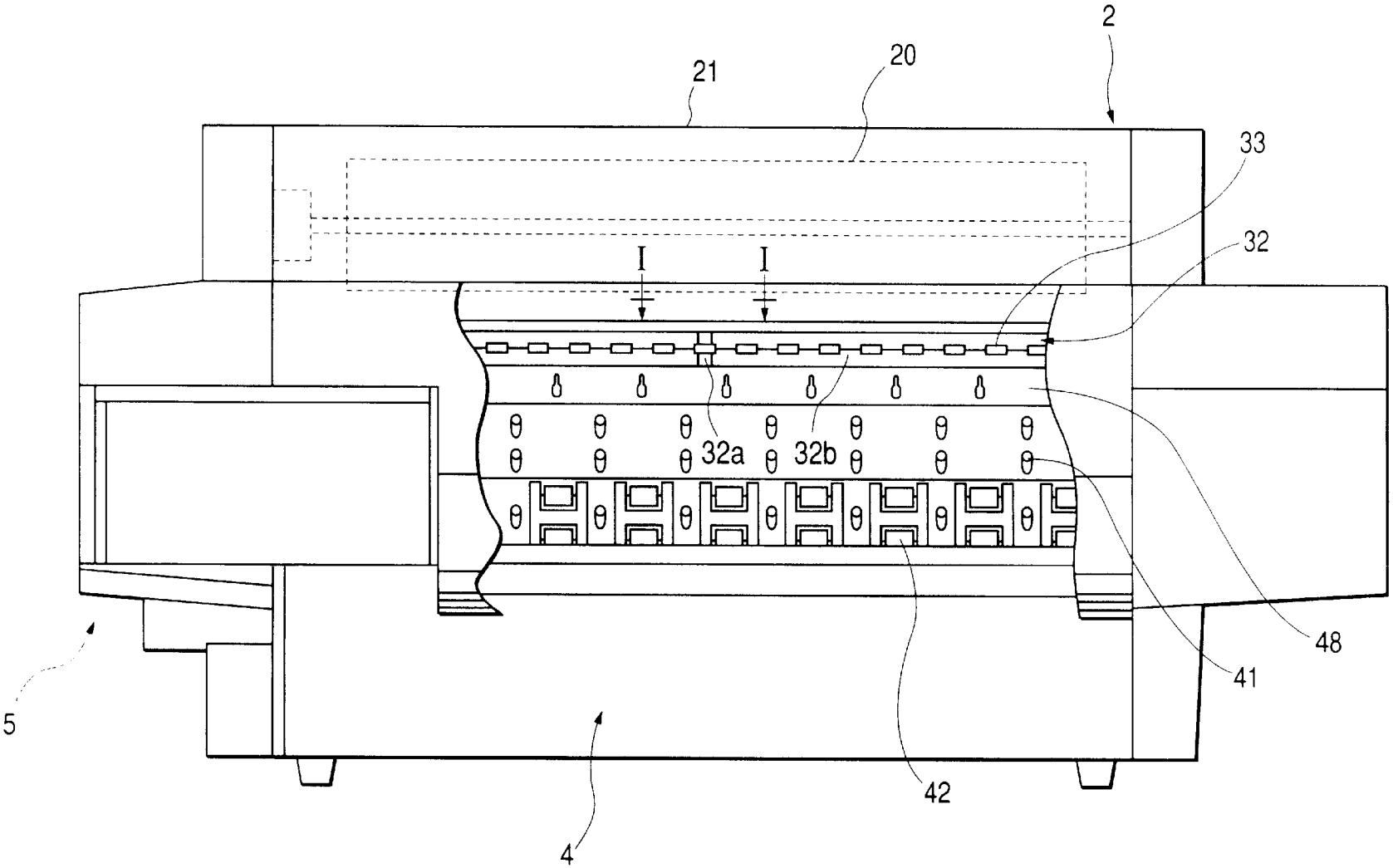
FIG. 2 is a front view showing a state where a carriage of the recording apparatus is removed.
Figure 3:
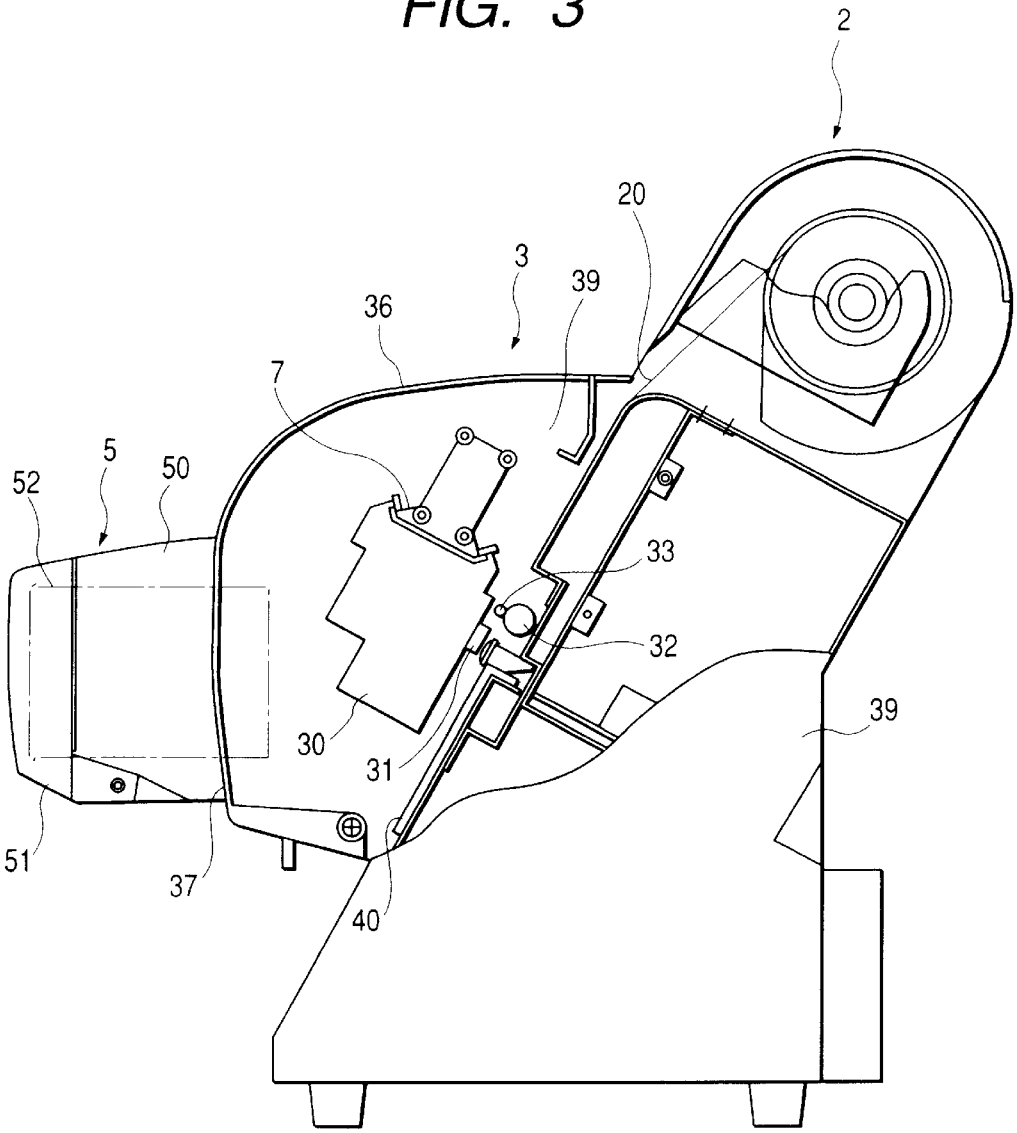
FIG. 3 is a side view showing a state where a side frame of the recording apparatus is partly removed.
Figure 4:
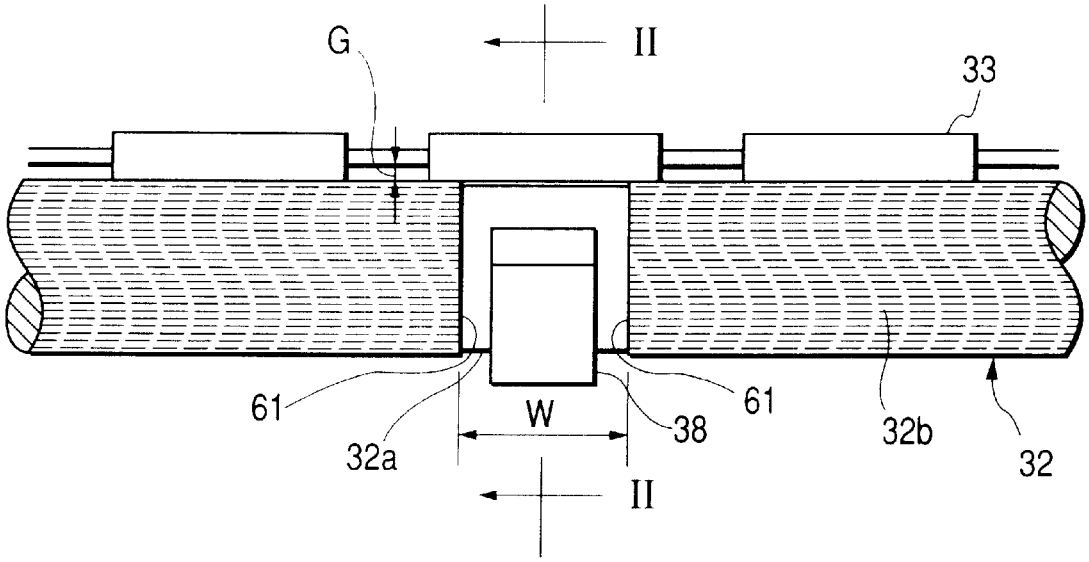
FIG. 4 is a plan view of a transport roller and driven rollers according to a first embodiment of the invention, which is viewed from a line I—I in FIG. 2.
Figure 5:
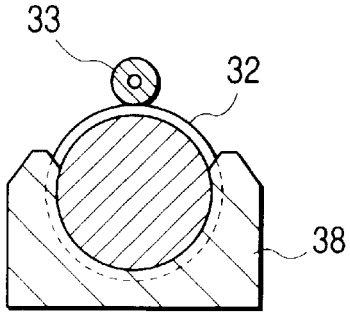
FIG. 5 is a sectional view taken along a line II—II in FIG. 4.

The explanation will be made in detail as to the transport roller and the driven rollers according to the present invention. FIG. 4 is a plan view which is viewed from a line I—I in FIG. 2 and FIG. 5 is a section view taken along a line II—II in FIG. 4.

The transport roller 32 has high rigidity and is pivotally supported at its both ends by the bearing portion (not shown) of the side frame 39. The transport roller 32 is arranged in a manner that the surface thereof supported by a center supporting member 38 is formed as a low-friction surface 32*a* and the surface thereof except for the low-friction surface 32*a* is formed as a high-friction surface 32*b* whose diameter is made slightly larger than that of the low-friction surface 32*a*. In this embodiment, the high-friction surface 32*b* is formed by the known ceramic coating process in which ceramic particles such as silicon carbide is dispersed uniformly. The low-friction surface 32*a* is formed by the polish finishing process, for example. In this embodiment, the diameter of the high-friction surface 32*b* is made slightly larger than that of the low-friction surface 32*a*. In this respect, "the degree of the slightly large diameter" means the degree sufficient for defining the low-friction surface. Specifically, the diameter of the high-friction surface is made larger than that of the low-friction surface by almost the thickness of the ceramic coating. Of course, the diameter difference between the high-friction surface and the low-friction surface may be slightly smaller or larger than the thickness of the ceramic coating.

The thickness of the coating forming the high-friction surface 32*b* is in a range of 15 $\mu$m to 100 $\mu$m. In view of the fact that the friction coefficient of the surface of the transport roller 32 is too small when the coating film is less than 15 $\mu$m and that the coating film becomes weak when the coating film is too thick, the thickness of the coating film is preferably about 30 $\mu$m.

In contrast, a gap (shown by G in FIG. 4) between a lower face of a shaft of the driven roller 33 and the high-friction surface 32*b* is in a range of 1.5 mm to 1.7 mm, which is quite larger as compared with the thickness of the coating film of the high-friction surface 32*b*.

At respective boundary portions 61 between the high-friction surface 32*b* and the low-friction surface 32*a* of the transport roller 32, the driven roller 33 is disposed to oppose to the high-friction surface 32*b* and the low-friction surface 32*a* in a manner that the surface of the driven roller extends over the boundary portions 61. In this manner, when the driven roller 33 is urged against the transport roller 32, the surface of the driven roller 33 is slightly so deformed elastically as to be bent toward the low-friction surface 32*a* of the transport roller 32. Thus, the gap between the driven roller 33 and the low-friction surface 32*a* further reduced or almost eliminated over the entire width of the low-friction surface 32*a*.

Thus, even though the low-friction surface 32*a* is provided, a force for gripping the paper surely acts on the paper, so that the paper can be transported stably.

Further, the recording paper running between the driven roller 33 and the low-friction surface 32*a* is restricted in a state that the paper extends over the low-friction surface 32*a* and the high-friction surface 32*b* by the surface of the driven roller 33 at the boundary portions 61 of the transport roller 32, and the elastically-deformed driven roller 33 almost eliminates the gap with respect to the low-friction surface 32*a*, so that the generation of origin of the cockling phenomenon at the low-friction surface 32*a* portion can be suppressed.

In this embodiment, the low-friction surface 32*a* of the transport roller 32 is disposed so as to oppose to the surface of the driven roller 33 having a width larger than the width w of the low-friction surface 32*a*. A rubber roller which surface is coated by fluorine, for example, is employed as the driven roller 33. The driven roller is always biased by a not-shown biasing member which provides pressure toward the transport roller 32.

Since the difference (diameter difference) between the outer diameter of the low-friction surface 32*a* and the outer diameter of the high-friction surface 32*b* is set to be the thickness (from 15 $\mu$m to 100 $\mu$m) of the coating forming the high-friction surface 32*b*, the gap between the low-friction surface 32*a* of the transport roller 32 and the driven roller 33 is made small and the generation of the origin of the cockling phenomenon at the low-friction surface 32*a* portion can be suppressed.

When the width of the surface of the driven roller 33 exceeds the width w of the low-friction surface 32*a*, the surfaces at the both end portions of the driven roller 33 provide pressure towards the high-friction surface 32*b* of the transport roller 32, so that the surface of the driven roller 33 opposing to the low-friction surface 32*a* of the transport roller 32 is partially and slightly so deformed elastically as to bent toward the low-friction surface 32*a* of the transport roller 32. Thus, the gap between the driven roller 33 and the low-friction surface 32*a* further reduced or almost eliminated over the entire width of the low-friction surface 32*a*. The paper feeding procedure is performed under such a circumference in a manner that the recording paper is pushed against the transport roller 32 by the driven roller 33, the transporting stability of the paper can not be degraded and the generation of the origin of cockling phenomenon at the low-friction surface 32*a* portion can be suppressed.

The low-friction surface 32*a* of the transport roller 32 disposed on the opposite side of the driven roller 33 is pivotally supported by the center supporting member 38. Since the low-friction surface 32*a* of the transport roller 32 is rotatably supported at the center portion thereof, the friction between the low-friction surface and the center supporting member 38 is small and hence the transport roller 32 can be rotated smoothly, and abrasion of the center supporting member 38 can be suppressed.

In this embodiment, as the surface of the driven roller 33 having the width larger than the width w of the low-friction surface 32*a* of the transport roller 32, the single driven roller having the length larger than the width of the low-friction surface 32*a* is employed. However, such a surface of the driven roller having the width larger than the width w of the low-friction surface 32*a* may be formed by a plurality of the driven rollers. To be more concrete, a plurality of the driven rollers may be arranged coaxially in a manner that the surfaces formed by these driven roller form a substantially continuous surface and the entire width of the continuous surface of these driven rollers exceeds the aforesaid width w if only it is satisfied the condition that the driven roller 33 is disposed to oppose to the high-friction surface 32*b* and the low-friction surface 32*a* in a manner that the surface the driven roller extends over the boundary portions 61.

Figure 6:
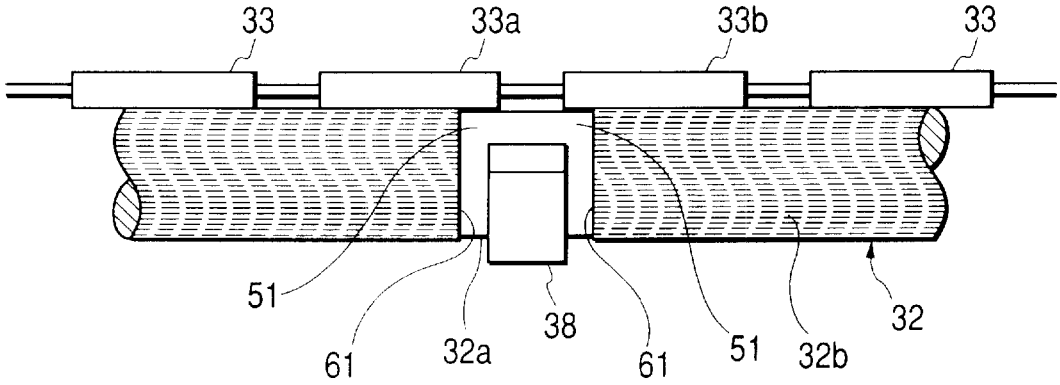
FIG. 6 is a plan view of a transport roller and driven rollers according to a second embodiment of the invention.

A second embodiment adopting such a configuration is shown in FIG. 6. At the respective boundary portions 61 of the low-friction surface 32*a* of the transport roller 32, the surfaces of adjacent two driven rollers 33*a*, 33*b* are disposed to oppose to a low-friction surface 32*a* and a high-friction surface 32*b*, respectively, and the two driven rollers 33*a* and 33*b* are separated to each other. In the figure, reference numerals 51 depict the end portions of the low-friction surface 32*a*. In brief, it is required that the end portions 51 of the low-friction surface 32*a* oppose to the surfaces of the driven rollers 33.

In this embodiment, a length of a portion of the driven roller 33*a* opposing to one end portion 51 of the low-friction surface 32*a* is same as a length of a portion of the driven roller 33*b* opposing to the other end portion 51 of the low-friction surface 32*a*. According to such a configuration, a uniform pressure is applied to the paper at the portions near the both end sides of the low-friction surface 32*a* of the transport roller 32, so that there does not occur a difference in the paper transport speed at the both end sides of the low-friction surface 32*a*.

Figure 7:
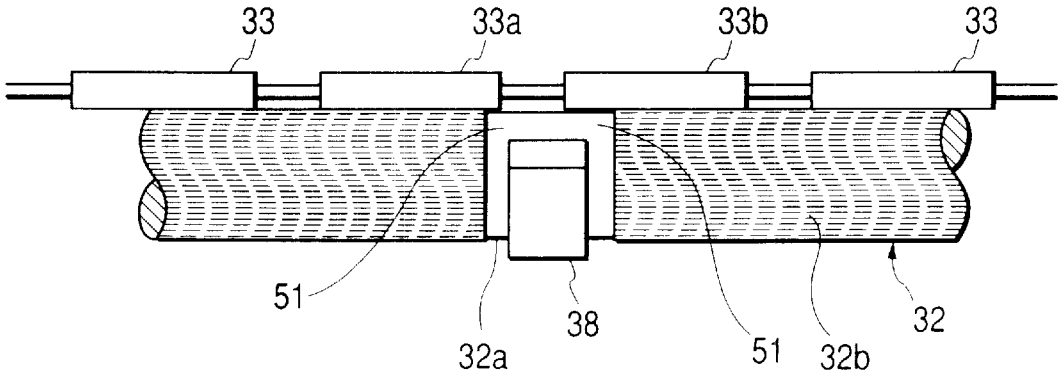
FIG. 7 is a plan view of a transport roller and driven rollers according to a third embodiment of the invention.

Of course, as shown in FIG. 7, a length of a portion of the driven roller 33*a* opposing to one end portion 51 of the low-friction surface 32*a* may be arranged to differ from a length of a portion of the driven roller 33*b* opposing to the other end portion 51 of the low-friction surface 32*a*, which is a third embodiment of the present invention.

Figure 8:
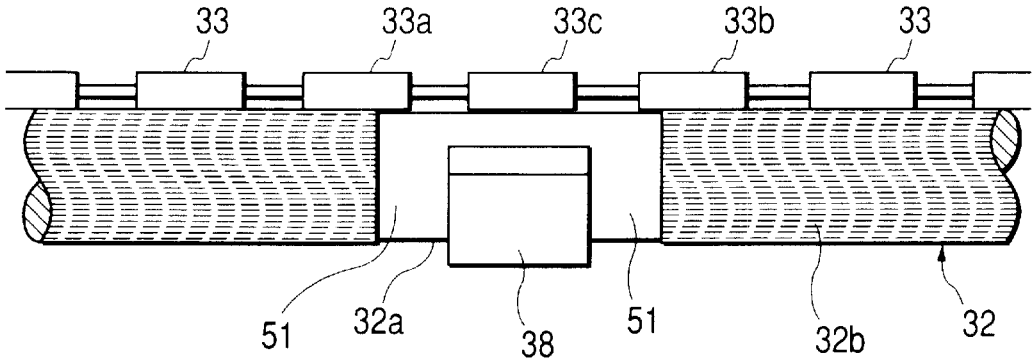
FIG. 8 is a plan view of a transport roller and driven rollers according to a fourth embodiment of the invention.

In an embodiment shown in FIG. 8, a plurality of driven rollers 33 having the same width are provided in opposite to a transport roller 32 in a manner that the surfaces of three of these driven rollers 33*a*, 33*b*, 33*c* are opposed to a low-friction surface 32*a*, which is a fourth embodiment of the invention. Each of the two driven rollers 33*a*, 33*b* opposes at a part of its surface to the low-friction surface 32*a*, while the driven roller 33*c* is positioned between the two driven rollers 33*a*, 33*b* and the entire surface thereof opposes to the low-friction surface 32*a*. In this case, two or more driven rollers may be disposed between the driven rollers 33*a*, 33*b* which are disposed in an opposite manner.

Figure 9:
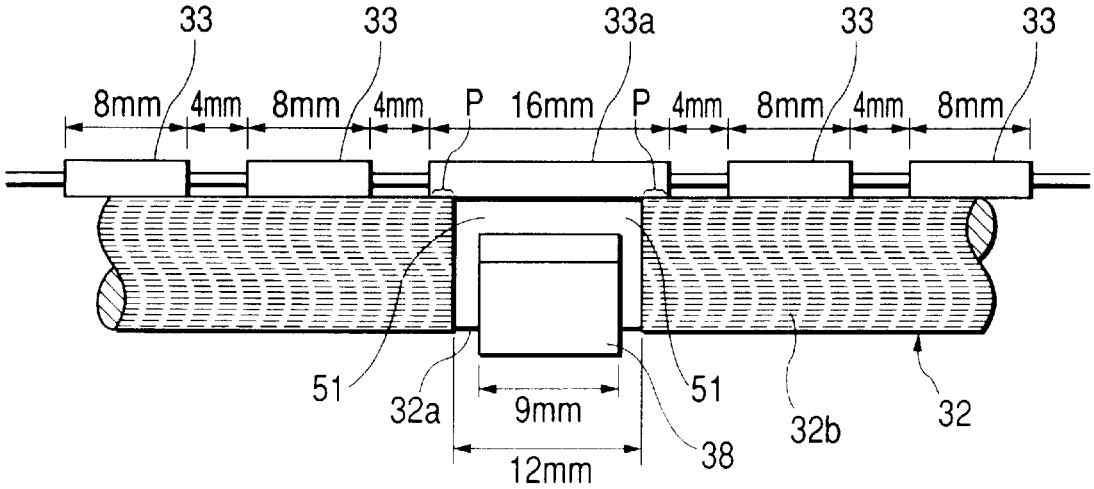
FIG. 9 is a plan view of a transport roller and driven rollers according to a fifth embodiment of the invention.

FIG. 9 shows a fifth embodiment which is a modification of the first embodiment shown in FIG. 4. This embodiment is same as the first embodiment in a point that the surface of a driven roller 33*a* opposing to a low-friction surface 32*a* is disposed so as to oppose to the entire width of the low-friction surface 32*a* of the transport roller 32 but differs in a point that the width of the driven roller 33*a* is lager than widths of other driven rollers 33 which do not oppose to the low-friction surface 32*a*. In FIG. 9, as an example of the preferred embodiment, there are shown specific dimensions a width of the driven roller 33*a* opposing to the low-friction surface 32*a*, widths of other driven rollers 33, a width of the low-friction surface 32*a*, a distance between the driven roller 33, etc. However, the invention is not limited to these sizes.

According to such an arrangement, the width of portions of the driven roller 33*a,* which is opposing the low-friction surface 32*a,* opposing the high-friction surface 32*b* (in FIG. 9, the width of this portion is represented by P and so a total width of the left and right portions is 2P) can be made close to the width of the other driven rollers 33. Thus, since the action affected on the transport roller 32 by the driven roller 33*a* opposing the low-friction surface 32*a* becomes similar to the action affected on the transport roller 32 by the other driven rollers 33, the paper can be transported more stably.

In the embodiment of FIG. 9, the total with 2P of the portions of the driven roller 33*a* opposing to the low-friction surface 32*a* which is opposing to the high-friction surface 32*b* can be made equal to the width of each of the other driven rollers 33.

Although the present invention has been shown and described with reference to specific preferred embodiments, various changes and modifications will be apparent to those skilled in the art from the teachings herein. Such changes and modifications as are obvious are deemed to come within the spirit, scope and contemplation of the invention as defined in the appended claims.

What is claimed is:

1. A recording apparatus comprising:

a first roller arranged parallel with a main direction of a recording head for transporting a recording paper, the paper transporting roller including a first portion provided with a surface having a first friction coefficient and a first diameter, and a second portion provided with a surface having a second friction coefficient larger than the first friction coefficient and a second diameter larger than the first diameter;

a second roller driven by the first roller while providing pressure to be applied onto the recording paper toward the first roller, the second roller opposed to the first roller such that a roller surface thereof extends over a boundary of the first portion and the second portion of the first roller; and a supporting member for supporting the first portion of the first roller rotatably thereon.

2. The recording apparatus as set forth in claim 1, wherein the roller surface of the second roller extends so as to oppose an entire width of the first portion of the first roller.

3. The recording apparatus as set forth in claim 2, wherein the second roller includes a plurality of individual driven rollers; and wherein a widthwise dimension of the individual driven roller opposing the entire width of the first portion of the first roller is larger than another individual driven rollers.

4. The recording apparatus as set forth in claim 1, wherein the roller surface of the second roller extends so as to oppose a part of the first portion of the first roller.

5. The recording apparatus as set forth in claim 4, wherein the roller surface of the second roller opposes both widthwise end portion of the first portion of the first roller.

6. The recording apparatus as set forth in claim 1, wherein the second roller includes a plurality of individual rollers respective widths of which are identical with each other.

7. The recording apparatus as set forth in claim 1, wherein the surface of the second portion of the first roller is defined by a coating layer.

8. The recording apparatus as set forth in claim 7, wherein a thickness of the coating layer is within a range of 15 $\mu$m to 100 $\mu$m.

9. The recording apparatus as set forth in claim 8, wherein the difference between the first diameter and the second diameter is twice of the thickness of the coating layer.

10. The recording apparatus as set forth in claim 9, wherein the second portion of the first roller is arranged in both sides portion of the first portion thereof, and urged by the second roller.

11. The recording apparatus as set forth in claim 1, wherein the supporting member is arranged so as oppose to the second roller through the first roller.

* * * * *